US006484475B1

(12) United States Patent
Neagle et al.

(10) Patent No.: US 6,484,475 B1
(45) Date of Patent: Nov. 26, 2002

(54) MODULAR PACKAGING MACHINE

(75) Inventors: Claud Andrew Neagle, Edgewood; Steven Ray Lonkard, Union, both of KY (US); Christopher Stuhlman, Frankenberg/Eder; Tieme Jan Slomp, Geldern, both of (DE)

(73) Assignee: Kisters Kayat, Inc., Edgewater, FL (US)

( * ) Notice: Subject to any disclaimer, the term of this patent is extended or adjusted under 35 U.S.C. 154(b) by 0 days.

(21) Appl. No.: 09/243,170

(22) Filed: Feb. 2, 1999

(51) Int. Cl.[7] ..... B65B 17/00

(52) U.S. Cl. ..... 53/167; 53/251; 53/248; 53/539

(58) Field of Search ..... 53/167, 251, 55, 53/201, 473, 248, 539, 497, 59, 67, 131, 452, 264, 543

(56) References Cited

U.S. PATENT DOCUMENTS 3,863,422 A * 2/1975 Wagner ..... 53/55
4,884,674 A 12/1989 Head
5,350,348 A 9/1994 Guot
5,406,772 A * 4/1995 Dinius ..... 53/67
5,588,282 A * 12/1996 Hartness ..... 53/473
5,595,043 A 1/1997 Radigan
5,660,262 A 8/1997 Landrum et al.
5,701,718 A 12/1997 Spada
5,706,627 A 1/1998 Kirka et al.
5,771,657 A * 6/1998 Lasher et al. ..... 53/55
5,778,634 A * 7/1998 Weaver et al. ..... 53/543
5,810,487 A * 9/1998 Kano et al. ..... 53/55

* cited by examiner

*Primary Examiner*—Eugene Kim
*Assistant Examiner*—Sameh Tawfik
(74) *Attorney, Agent, or Firm*—R. Christian Macke

(57) ABSTRACT

A packaging machine having multiple modules each performing a separate function in a packaging sequence. The modules are building blocks that are assembled to define a packaging machine. An infeed conveyor/lane divider module, a blank magazine and infeed tray module, a collation and synchronization module, a gluing and closing module, a turning module, a stacking module, a film cutting module, a film wrapping module and a heat shrink module are selectively assembled in various combinations to define machines that pack articles into trays, wrap the articles with heat shrink film, turn the packages, stack the packages for multi-tier packages, or any combination of these functions. The modules each have an independent conveyor driven by an onboard servo drive. The servo drives are coordinated to provide controlled flow of articles from module to module. The servo drives are all connected to and controlled by a supervisory computer such that no mechanical connection between modules is required.

8 Claims, 7 Drawing Sheets

MODULAR PACKAGING MACHINE

FIELD OF THE INVENTION

The present invention relates to packaging machines, particularly a wraparound packer, tray shrink packer, pad shrink packer and shrink packer machines, having modular components.

BACKGROUND OF THE INVENTION

The explosion of consumer items that are mass manufactured and sold to the public has resulted in the packaging of such items becoming an important and significant step in production. As a result, specialized packaging machines have been developed which are generally dedicated to a specific item, and which provide identical packaging with little flexibility to change the size, type or arrangement of the package or to adapt the machine to the item being packaged.

A number of packaging machines are well known in the art, including wraparound packers, tray shrink packers, pad shrink packers and shrink packer machines. Wraparound packers (WP), for instance, package consumer items in cardboard or paperboard cartons by folding and sealing a blank to form a box around the articles. Tray shrink packers (TSP), on the other hand, package articles by forming a cardboard tray around a group of articles, including folding and gluing upright panels of the tray, then wrapping heat shrinkable film around the tray and articles. Heat is applied and the film shrinks to define the TSP package. Pad shrink packers (PSP) position a pad beneath a group of articles, without forming a tray, and wrap the pad and articles in heat shrinkable film, after which heat is applied to shrink the film. A shrink packer (SP) wraps a sheet of heat shrinkable film around a group of articles without any support from a tray or pad, and applies heat to shrink the film and make the package rigid.

The various packaging machines (WP, TSP, PSP, SP) discussed above are used as efficiency dictates based upon the weight, rigidity and size of the articles and packages produced. If a small package is desired, for instance, which does not require a pad or tray for structural support, a shrink packer (SP) would be used because the expense and step of inserting a pad or tray is not necessary. For heavier or larger articles, however, a tray or pad may be necessary to give a package adequate rigidity and integrity.

In a number of specific examples, packaging machines have been designed to act as more than one type of the above described packaging machines (WP, TSP, PSP, SP). One specific application has been the use of a machine used as a tray shrink packer, pad shrink packer or shrink packer in the packaging of upright cylindrical articles, such as beverage bottles or cans. It is well known in the art that such articles can be conveniently and efficiently packaged in six pack, twelve pack, twenty-four pack, or forty-eight pack packages utilizing a tray shrink packer (TSP) machine. In prior art devices of this type, the articles are organized into a set to be packaged and a tray blank is positioned on a conveyor. The articles are then placed upon the tray blank and the tray blank is folded and glued to form a tray around the articles. Then, a film of heat shrinkable material is wrapped around the articles and tray, secured and heat shrunk to provide a package suitable for shipment to retailers or consumers. Bottles or cans may also be packaged in smaller packages utilizing a pad shrink packer (PSP) or shrink packer (SP) machines. In a pad shrink packer (PSP) machine, a simple pad, rather than a tray blank, is placed under the articles and the step of forming the tray, the step just prior to the wrapping with and heating of film, is eliminated. In a shrink packer machine, no tray blank or pad is placed beneath the articles. The film is wrapped and heat shrunk, without a need for additional support from a pad or tray, to complete the package.

A number of prior art packaging machines have provisions for performing additional operations during the packaging sequence. Specifically, some prior art packaging machines include provisions for turning the packages prior to exiting the machine to aid in further handling and shipment. Also, it is known in the art that successive groups of articles can be stacked by a properly equipped packaging machine to provide a two-tiered package. In tray shrink packer (TSP) machines, for instance, prior art devices have included stacking between the folding and gluing tray forming step and the application of the heat shrinkable film, so that twenty-four packs of cans in trays can be placed in a two-tier stack to provide a forty-eight article package. Heat shrinkable film is then wrapped, secured and heated to shrink it to provide a secure rigid two-tier package.

In the prior art packaging machines described above, packaging of articles is generally performed in a multiple step sequence. Initially the articles, such as beverage cans or bottles, are received in random, unordered arrangement. An infeed conveyor arranges the articles into lanes for further processing. A group of the laned articles is then separated out by a collator which separates the laned articles into package groups by using separator bars mounted on the conveyor which receive the laned articles from the infeed conveyor/lane divider.

In a wraparound packer (WP), a cardboard blank is then provided from a tray magazine and positioned beneath the group of articles being packaged. The blank is then folded and glued to form a box around the packaged articles.

In a tray shrink packer (TSP) machine, the next step in the sequence after the formation of package groups is to register the articles onto a cardboard blank. A blank is supplied from a magazine and is positioned beneath the group of articles being packaged. Outer extending flanges of the tray are then folded upright and glued together around the group of articles to form a packed tray. In a pad shrink packer (PSP), a pad, rather than a tray blank, is positioned beneath the articles being packaged and there is no step of folding and gluing the flanges.

In tray shrink packer (TSP), pad shrink packer (PSP) and shrink packer (SP) machines, a sheet of heat shrinkable film is wrapped around the articles and the pad (PSP machine), and the tray (TSP machine). The film is secured and the package wrapped in film, is conveyed into an oven wherein heat is applied to shrink the film into tight engagement. In prior art packaging machines equipped for such, the steps of turning or stacking packages are performed prior to the application of heat shrinkable film.

In prior art packaging machines utilizing the multiple step packaging sequence described above, it is desirable to keep the machine operating continuously, without interruption, for maximum efficiency. While the articles are moved from section to section in sequence in a packaging machine, it is necessary to control the movement so that the number of articles being processed in every section is the same or appropriately cycled to allow continuous operation. To effect continuous processing in every section of the machine, prior art packaging machines have utilized, either a single conveyor which moves the articles through the packaging sequence, or a number of individual conveyors which are mechanically linked to ensure same speed processing in all sections of the packaging machine. A single mechanical drive providing the motive force for all of the conveyors in a packaging machine solves the continuity problem by having all the sections operating at the same speed, but it has the significant disadvantage of having complicated mechanical interconnections that make it difficult to isolate sections of the machine for maintenance.

The prior art packaging machines described above have equipment to perform all of the desired functions mechanically interconnected and mounted on a large frame. Even when multiple conveyors are used to move the articles through the various steps in the packaging sequence, the conveyors are mechanically interconnected and a large frame is provided on which the conveyors and other packaging equipment are mounted and affixed.

A significant disadvantage of the prior art packaging machine wherein multiple sequential steps are performed is that a breakdown or malfunction of any step in the sequence incapacitates the entire machine. To remove a portion of a prior art packaging machine it is necessary to mechanically disconnect and remove the problem equipment from the large frame. When a single drive motor with multiple belts or couplings is utilized, the isolation of a single section is difficult and time consuming. Particularly in the case of a major breakdown requiring the manufacturer of the machine to repair or adjust it, it is a significant expense and effort for the user to either ship the entire frame mounted packaging machine in for repair or to have a specialist come on site to effect the repair. The size of a packaging machine performing multiple sequential steps, particularly the large frame on which equipment is mounted, along with the complicated mechanical interconnections therein, make the prior art packaging machines undesirable because a catastrophic equipment failure of any single step in the sequence abruptly halts packaging and manufacturing. Performing repairs on these prior art packaging machines is difficult because the complicated mechanical interconnections make accessibility difficult.

In addition to the foregoing shortcomings, the prior art packaging machines are also disadvantageous in that they are not flexible or easily altered to package different articles or provide different kinds of packages. Until now, when a desired packaging scheme was identified, a machine was designed to perform the various steps of lane dividing, collation, tray or pad positioning, tray forming, shrinkwrapping, stacking, etc. to repetitively provide the desired package. To eliminate a step from the sequence, such as removing the step of stacking, tray forming, etc. mechanically disengagement of equipment, including coordinated conveyors, and provision for the package group to pass through the disengaged section were necessary. It is a complicated endeavor to remove mechanically linked equipment in the machine.

In addition to the above-described disadvantages, maintenance of prior art packaging machine is problematic. Mechanical linkages between steps and equipment in the sequence must continually be fine tuned to ensure systematic processing and to ensure that all sections operate at the same speed or under controlled cycling.

It is desirable to provide a packaging machine which is not mounted on a large frame wherein steps in the packaging sequence comprise individual steps performed by separate, compartmentalized modules. Such a packaging machine can be easily modified to alter the packaging sequence by inserting or deleting a module. One embodiment of the present invention provides for each module to be driven independently without mechanical linkages to the preceding and proceeding modules in the sequence, and thus requires precise control of the speed with which each module is operating. To ensure continuous operation, the speed at which the modules operate must be coordinated, so a supervisory control over all of the modules is required. Another embodiment discloses the use of quick connect mechanically couplings between consecutive modules to take advantage of their modular nature while allowing multiple modules to be driven by a single drive.

OBJECTS OF THE INVENTIONS

Accordingly, it is an object of the present invention to provide a packaging machine comprising multiple modules that may be inserted or removed to alter the packaging machine and sequence to define the package produced thereby.

It is also an object of the present invention to provide a packaging machine wherein the means for moving articles and a package group therethrough are linked between modules by simple disengageable mechanical couplings.

It is also an object of the present invention to provide a packaging machine comprising interconnected modules that do not require a frame for structure or support.

It is a further object of the present invention to provide a packaging machine wherein multiple independent modules have independent conveyors driven by mechanically independent servo drives.

It is another object of the present invention to provide a modular packaging machine wherein a supervisory computer coordinates and controls independent servo drives on each of various modules in such a manner that continuous packaging is accomplished.

It is yet another object of the present invention to provide a modular packaging machine wherein multiple modules share a drive means through the use of quick connect means.

It is a further object of the invention to provide a modular packaging machine wherein separate modules may be easily inserted or removed from the stream of packaging without complex mechanical attachment or detachment.

It is a further object of the present invention to provide a modular packaging machine wherein it is not necessary to mount equipment performing discrete functions in the packaging process on a continuous frame.

It is another object of the present invention to provide a modular packaging machine wherein the speed with which each module operates is computer controlled to allow flexibility to speed up or slow down the module by simply reprogramming the computer without the need for mechanical adjustment or modification.

These and other objects of the present invention are satisfied by the embodiments of the invention described in more detail herein. These objects are meant to be illustrative and not limiting. The manner of operation, novel features and further objects and advantages of this invention may be better understood by reference to the description and drawings set forth herein.

SUMMARY OF THE INVENTION

According to the foregoing objectives, this invention is a packaging machine comprising multiple modules, each of the modules performing a separate function in the packaging sequence. Articles being packaged are conveyed through the machine by individual conveyors provided on each of the modules. The flow of articles through the packaging machine is controlled to allow continuous packaging by providing a controller which coordinates the speeds at which each of the modules and individual conveyors operate.

A significant advantage of the present invention is that, as a result of the modular nature of the components which do not require or depend on a frame for mounting, individual modules performing discrete packaging functions may be selectively added or removed to define or redefine the packaging machine. The full impact of this advantage is that a variety of different size, shape and format packages may be produced by simply inserting or removing modules into the stream of packaging. Functionalities can be provided to make the packaging machine a tray shrink packer, pad shrink packer, shrink packer, stacker, turner, or various combinations thereof, by inserting and removing modules to perform the specific and discrete packaging functions desired. The modules performing each of those functions are driven by independent and easily severed drive means, allowing each to function as if they are individual machines.

A preferred embodiment of the present invention is advantageously modular compared to prior art packaging machines because the compartmentalization of the steps in the packaging sequence into modules allows addition or removal of functionality without requiring mechanical redesign or complex retrofitting. A module can be physically positioned in the packaging machine between other modules and plugged into a supervisory computer or quickly connected to another computer controlled drive, the computer defining the speed with which the module operates and the packaging function is performed. The speed is controlled such that articles are processed through each module at a speed consistent with the rest of the machine, comprising other modules, to allow continuous packaging.

In a preferred embodiment of the present invention each module of the present invention has an onboard servo drive which provides the motive force and drives the conveyor responsible for moving the package group through the module. In addition, some modules are equipped with a second servo drive to provide the motive force for another element in the module, such as a film wrapper arm in a film wrapper module. These additional servo drives are also controlled by the supervisory computer and may be driven at nonuniform speeds as necessary for the rest of the packaging operation to continuously package articles.

In another preferred embodiment of the present invention two or modules share a drive means that are quickly and easily connected and disconnected. Specifically, a drive means comprising a drive shaft is positioned below the module's conveyor means. The drive shafts on successive modules are positioned and designed such that, when the modules are positioned next to one another, the drive shafts line up so that a quick connect coupling allows the modules to be quickly and easily linked together.

The present invention contemplates the use of nine (9) modules which may be combined to provide a wide variety of package formats. More modules may be added to provide additional discrete packaging functions without departing from the principles of the present invention. Each module performs a specific discrete function in the packaging sequence and, in the preferred embodiment wherein each module has an independent servo drive, each is plugged into the supervisory computer to become part of the packaging machine. An infeed conveyor/lane divider module receives articles and separates them into lanes. An onboard servo drive controlled by the supervisory computer determines the speed of the conveyor and the speed with which the articles are laned.

A collation and synchronization module is provided which separates the laned articles into package groups for further processing and, when it is desired to provide a pad shrink packer or tray shrink packer, a pad or blank is received from the blank magazine and registered under the package group. The computer controls the speed of the conveyor and, thus the speed with which package groups are processed, as well as the speed with which the pad or blank is received and registered under the package group.

When the machine is to function as a tray shrink packer, the next step in the packaging sequence is performed by a gluing and closing module, inserted to perform a function in the packaging sequence wherein the blank is folded and glued to form a tray around the package group. An onboard servo drive which drives the conveyor and thereby defines the speed of processing through the gluing and closing module is controlled by the supervisory computer to be consistent with other modules.

When it is desired to either turn the package for reorientation or to stack two (2) packages to create a two-tier package, separate modules are available to do both under the principles of the present invention. A turning module includes an onboard servo drive which defines the speed with which packages are processed through the turning module and which is controlled by the supervisory computer. The stacker module, on the other hand, includes an onboard servo drive on the conveyor which defines the speed with which packages are processed through the stacker, but it also includes a second servo drive which drives the lift arms at an accelerated pace. The supervisory computer provides for the acceleration and deceleration of the lift arm drive to effect the stacking. The supervisory computer controls the two (2) drives independently and at a speed consistent with the rest of the machine.

Whenever it is desired to provide heat shrink wrapping functionality, as with a shrink packer, pad shrink packer or tray shrink packer, three (3) additional modules are added. A film cutting module is provided which provides appropriately sized sheets of heat shrinkable film for the package group. An onboard servo drive on the film cutting module is controlled by the supervisory computer to generate the proper length of film and to deliver it when necessary. A film wrapping module receives the sheet of film and wraps it around the package group through the use of a wrapping arm. An onboard servo drive on the film wrapping conveyor defines the speed with which packages are processed through the module, while a second servo drive on the film wrapping arm drives the arm at an accelerated speed that allows the film to be completely wrapped around the package group including the pad or tray. Finally, a heat shrink tunnel module is provided wherein heat is applied to shrink the film into tight engagement with the package group. A variable speed drive on the heat shrink conveyor defines the speed with which the package groups are processed through the heat shrink tunnel.

In another embodiment of the present invention, a modular packaging machine of the type described above is provided wherein successive modules share drive means that are quickly and easily coupled and uncoupled. Specifically, individual compartmentalized modules, such as the nine described above, are provided. The conveyor in a specific module is mechanically linked to and driven by, in this embodiment, a drive shaft mounted below the conveyor. The modules are designed such that the center line of the drive shaft is identical in all modules so that, when two modules are positioned in succession in the packaging sequence, the drive shafts may be quickly and easily mechanically coupled together. Multiple modules are driven by a single motor in this way while the modularity of the packaging machine is retained. The function of the packaging machine thus remains flexible through the insertion or removal of modules as desired.

Although the present invention discloses the use of nine (9) modules, additional modules providing other packaging functionalities are contemplated. Specifically, modules providing functions which include onboard servo drives or which provide means for quick insertion or removal into the stream of packaging to change the functionality of the packaging machine do not depart from the principles of the present invention.

DETAILED DESCRIPTION OF THE INVENTION

Figure 11:
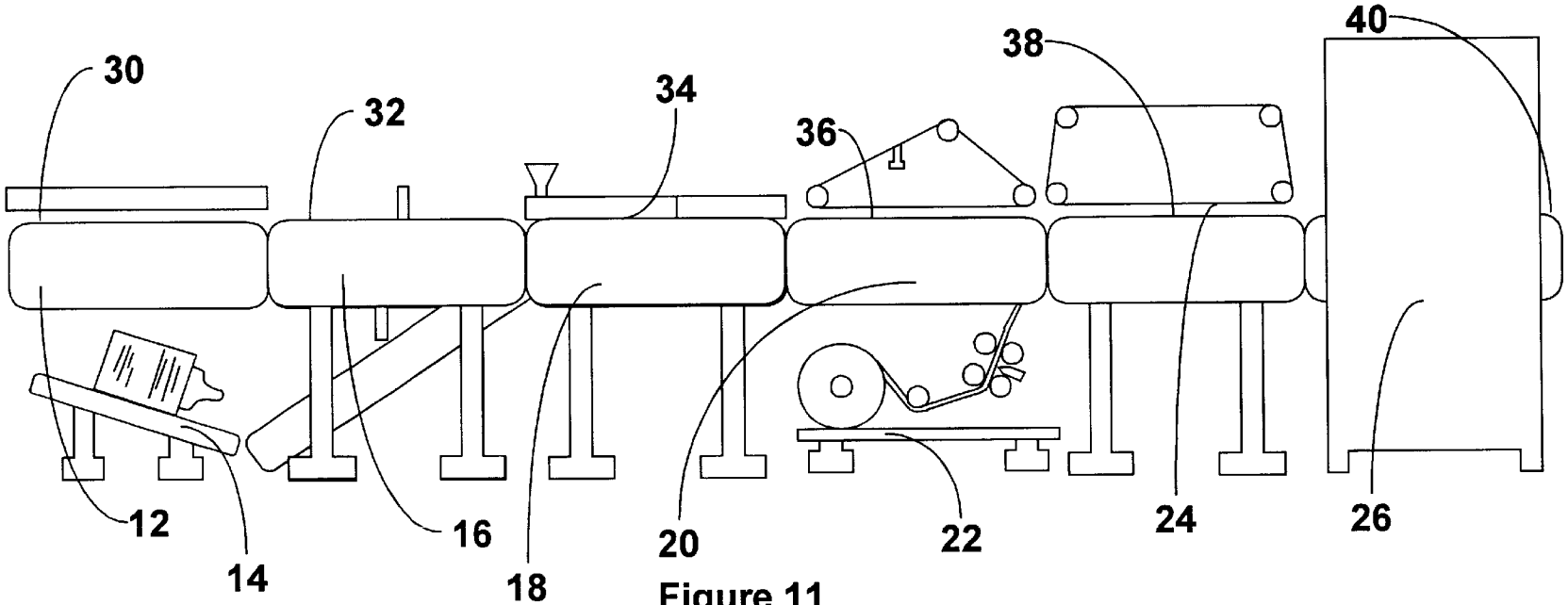
FIG. 11 is a side view of a packaging machine comprising multiple modules, including an infeed conveyor lane divider module, a blank magazine and infeed tray module, a collation and synchronization module, a gluing and closing module, a stacker module, a film cutting module, a film wrapping module, and a heat shrink tunnel module.

A preferred embodiment of the modular packaging machine 10 of the present invention is illustrated in FIG. 11. Specifically, the modular packaging machine 10 shown in FIG. 11 includes multiple modules, each of the modules performing a function in the packaging of articles. An infeed conveyor lane divider module 12, a blank magazine and infeed tray module 14, a collation and synchronization module 16, a gluing and closing module 18, a stacker module 20, a film cutting module 22, a film wrapper module 24, and a heat shrink tunnel module 26, comprise the packaging machine shown in FIG. 11. Modules providing other functions including, without limitation, a turner module (see FIG. 5) can be added to the packaging machine 10 shown in FIG. 11 without departing from the principles of the present invention.

Articles are received and packaged by sequentially going from module to module in the packaging stream of the modular packaging machine 10 of the present invention. Specifically, means for conveying are provided in each module that move articles and packages along from module to module. An infeed and lane divider conveyor 30, a collation and synchronization conveyor 32, a gluing and closing conveyor 34, a stacker conveyor 36, a film wrapper conveyor 38, and a heat shrink tunnel conveyor 40, all move articles through their respective modules and onto the next module. The conveyors are arranged at identical heights to allow one module to be butted up against an adjoining module without the need for any additional mechanical connection or adjustment therebetween.

Figure 1:
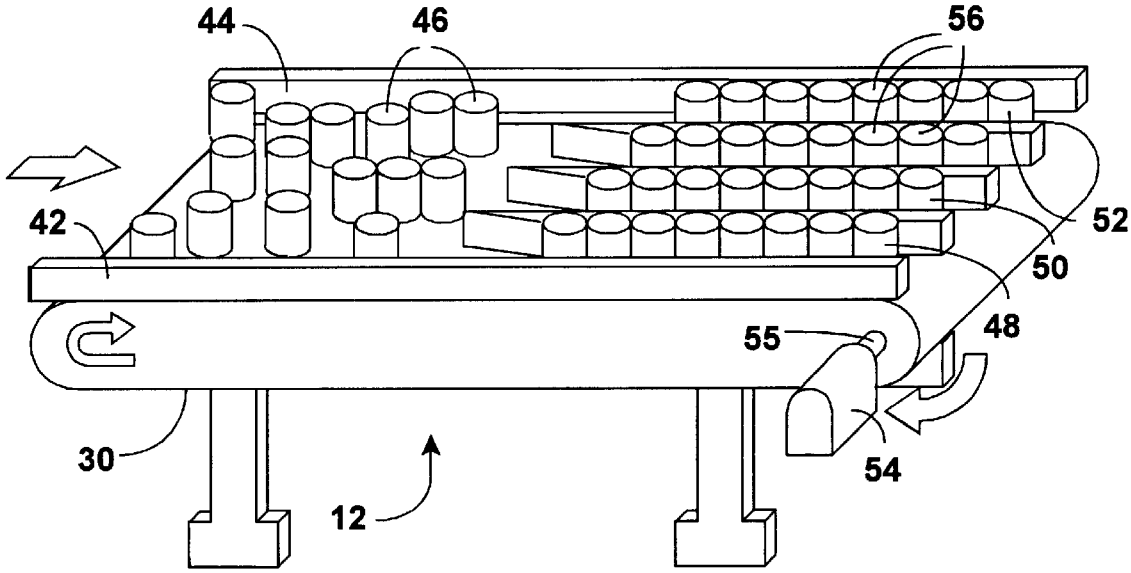
FIG. 1 is a perspective view of an infeed conveyor lane divider module which is freestanding and includes an onboard servo drive.

The first module, the infeed conveyor lane divider module 12, is shown in FIG. 1. Articles 46 are received in unordered arrangement and held on the conveyor 30 by infeed side rails 42, 44. The infeed conveyor 30 is driven in the direction shown and moves the unordered articles 46 into lanes defined by the side rails 42, 44 and lane dividers 48, 50, 52. The articles emerge from the infeed conveyor lane divider module 12 as laned articles 56. A servo drive 54 provides the motive force for the infeed lane conveyor 30 thereby defining the speed of the conveyor 30 and of articles 46, 56 transported thereby. The servo drive 54 is coupled to the infeed lane conveyor 30 by coupling 55. The servo drive 54 is depicted in FIG. 3 as being side mounted, although other mountings and mechanical connections to the conveyor 30 are contemplated and do not depart from the principles of the present invention.

Figure 3:
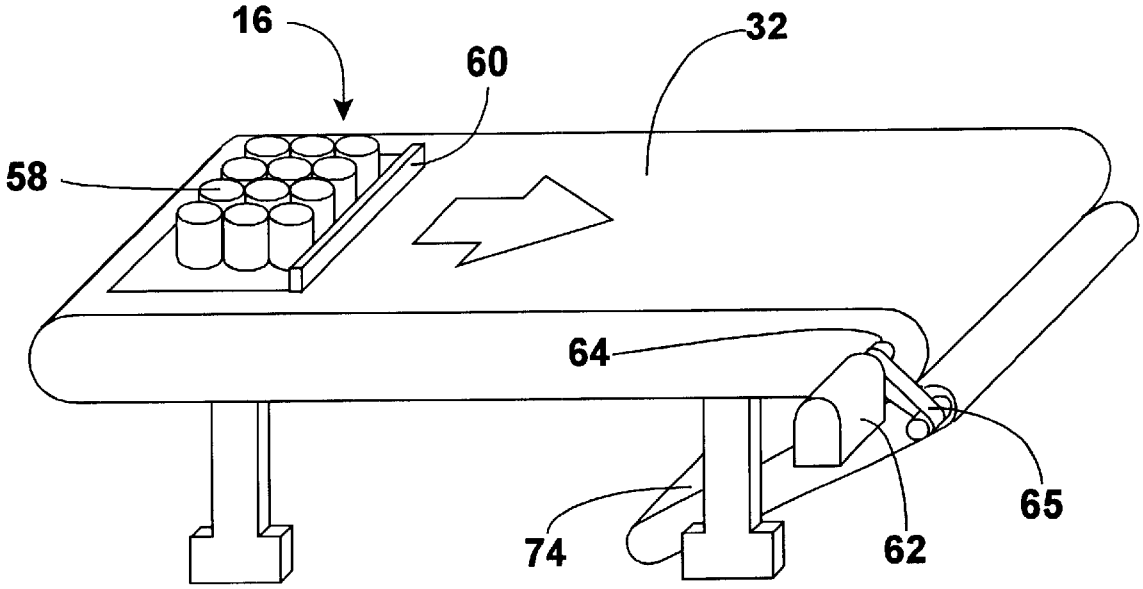
FIG. 3 is a perspective view of a collation and synchronization module including an onboard servo drive and depicting the separation of articles into package groups and the registration of tray blanks thereunder for traypacker operation.

The next module in the packaging machine 10 shown in FIG. 11, the collation and synchronization module 16, separates the laned articles 56 into a process group 58 (see FIG. 3). The collation and synchronization module 16 receives laned articles 56 and separates them into a process group 58 by inserting a separator bar 60. The separator bar 60 is mounted on and travels with collation and synchronization conveyor 32. The separator bar 60 moves in the direction indicated in FIG. 3 and moves the process group 58 along with it. A servo drive 62 provides the motive force for the collation and synchronization conveyor 32 and thereby defines the speed of the conveyor 32 and the process group 58 transported thereby. Similar to the other modules discussed herein, the servo drive 62 of the collation and synchronization module 16 is shown being side mounted and coupled to the conveyor 32. Other mechanical linkages between the servo drive 62 and conveyor 32 are contemplated by the principles of the present invention.

Figure 2:
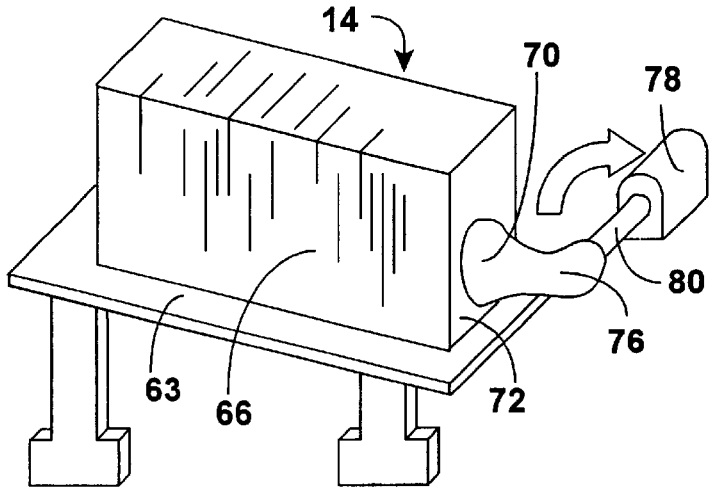
FIG. 2 is a perspective view of a blank magazine and infeed tray module including an onboard servo drive that supplies the blanks for traypacker operation.

For a packaging machine that is to include capabilities as a pad shrink packer or tray shrink packer, a pad or blank magazine and infeed module 14 is required. A stack of cardboard blanks 66 resting on an inclined tabletop 68 is provided from which pads or trays are provided for each process group 58. Specifically, a suction cup 70 engages the top pad or blank 72 of the stack 66, rotates about extension arm 76 in the direction shown in FIG. 2, and places the pad or blank 72 on an elevator conveyor 74 mechanically linked to the collation and synchronization module 16 (see FIG. 3). The pad or blank 72 is positioned under the pack group 58 as shown in FIG. 3. The elevator conveyor 74 is mechanically linked by a belt 65 to the collation and synchronization conveyor 32, which is driven by servo drive 62. It is contemplated that a separate drive for the elevator conveyor 74 may be used without departing from the principles of the present invention. On the blank magazine and infeed module 14 the suction cup 70 is driven by a servo drive 78.

Figure 4:
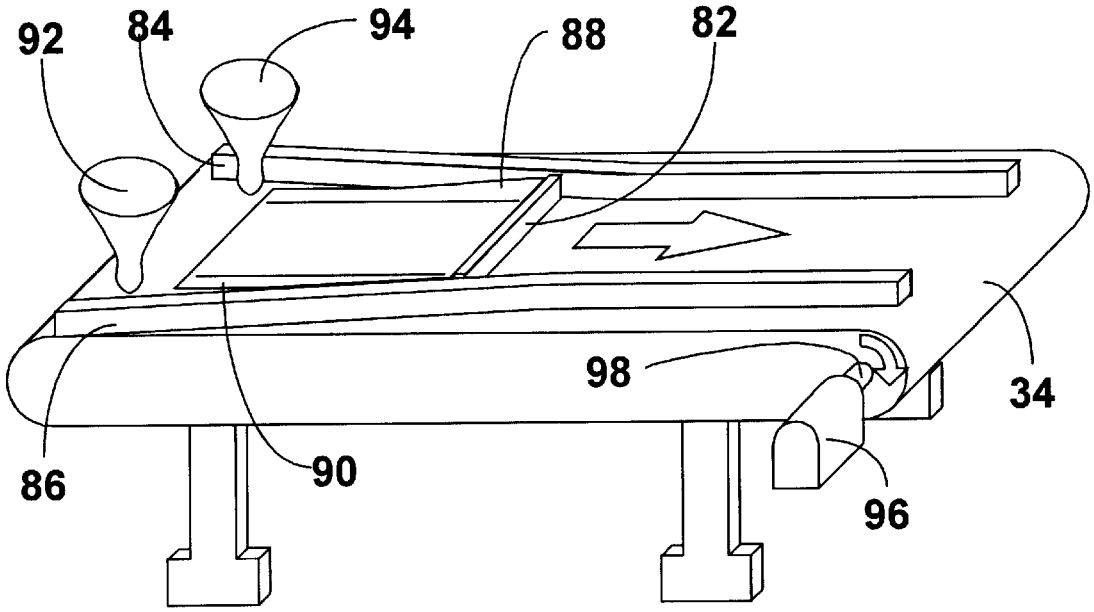
FIG. 4 is a perspective representation of a gluing and closing module having an onboard servo drive wherein tray blanks are folded and glued by contacting fold bars.

For specific use as a tray shrink packer a gluing and closing module 18 is provided in packaging machine 10 to complete the tray formation. The gluing and closing conveyor 34 includes a separator bar 82 similar to the collation and synchronization separator bar 60. The separator bar 82 controls the flow of the process group 58 through the gluing and closing module 18. As the process group 58 and blank 72 proceed through the gluing and closing module 18, the extended side flaps 88, 90 of the blank 72 engage angled fold bars 84, 86 and are folded upright as a result (see FIG. 4). Glue applicators 92, 94 apply adhesive to the side flaps 88, 90 prior to folding so that, after engaging the fold bars 84, 86 the tray retains the shape of a tray around the pack group 58. A servo drive 96 defines the speed of the gluing and closing conveyor 34, thereby also defining the speed with which packages are processed through the gluing and closing module 18.

Figure 5:
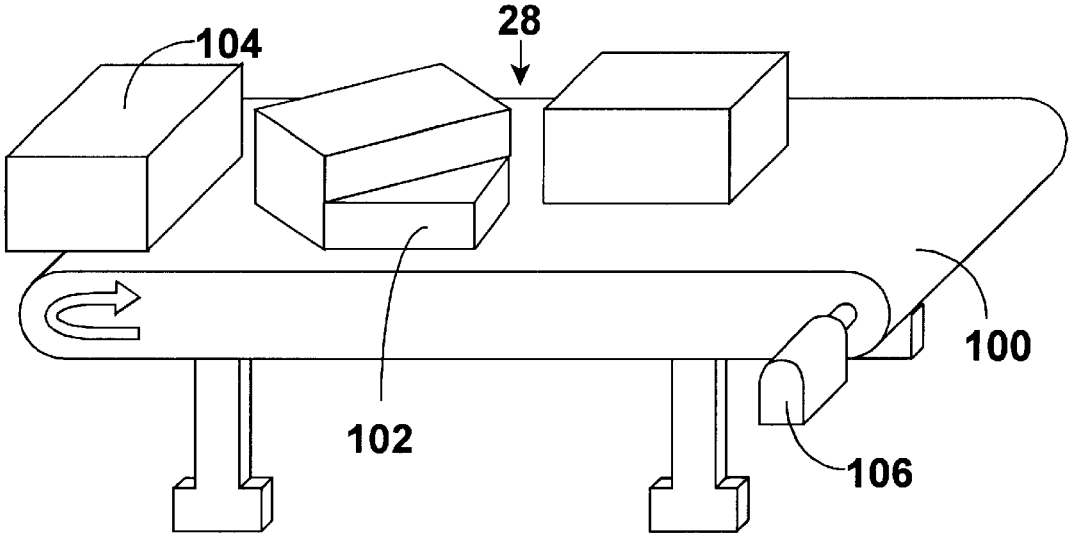
FIG. 5 is a perspective view of a turning module wherein an onboard servo drive defines the speed of the conveyor and the speed with which packages are processed therethrough.

After the gluing and closing module 18, a turner module 28 may be inserted to turn the package 104 as shown in FIG. 5. Specifically, a turner conveyor 100 receives the package 104 and moves it in the direction indicated in FIG. 5. When the package 104 engages an angled fixed block 102, the package is turned and reoriented as desired. A servo drive 106 drives the turner conveyor 100 and defines the speed of the conveyor 100 and, thereby, the speed with which packages are turned in the turner module 28.

Figure 6:
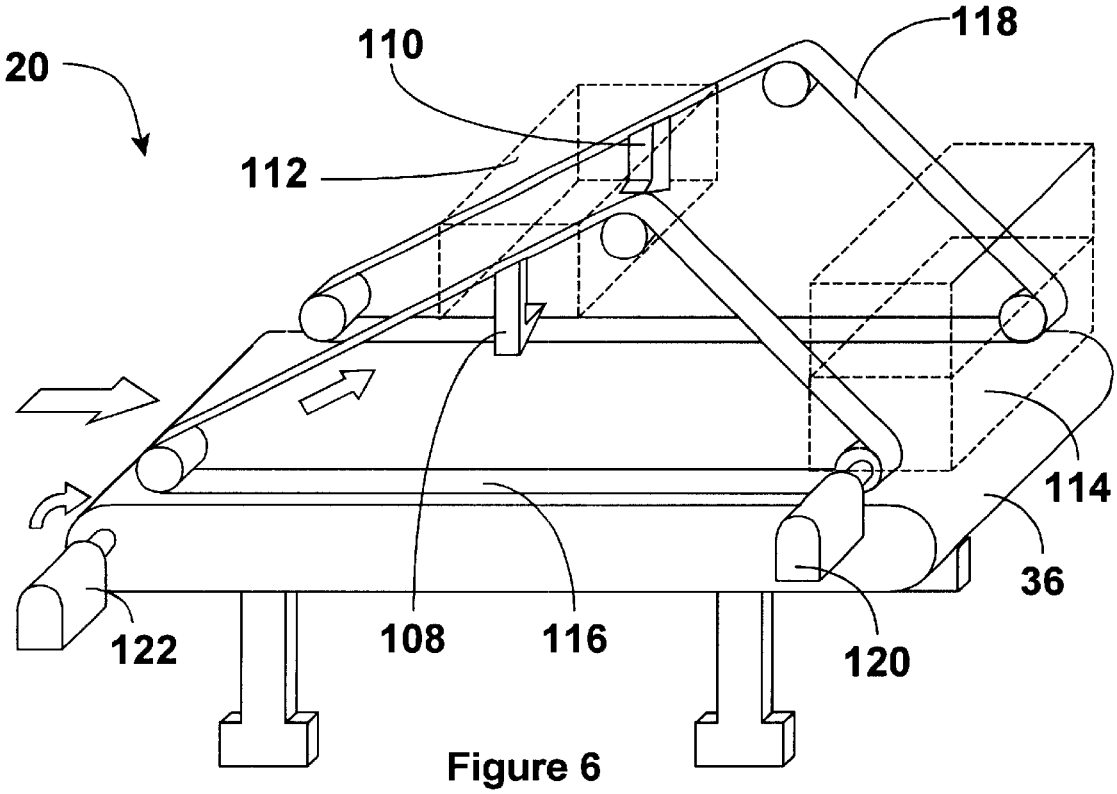
FIG. 6 is a perspective representation of a stacker module reflecting the use of two (2) onboard servo drives, one on the conveyor and one on the stacker lift arms.
Figure 7:
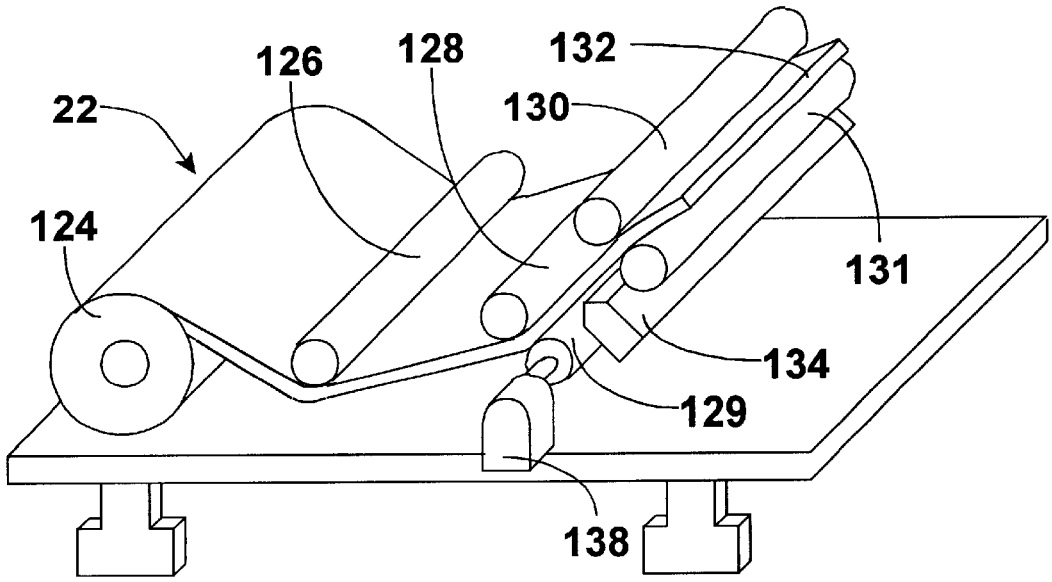
FIG. 7 is a perspective view of a film cutting module depicting a spool of film being fed and cut to wrap a package group with the film wrapper module.
Figure 8:
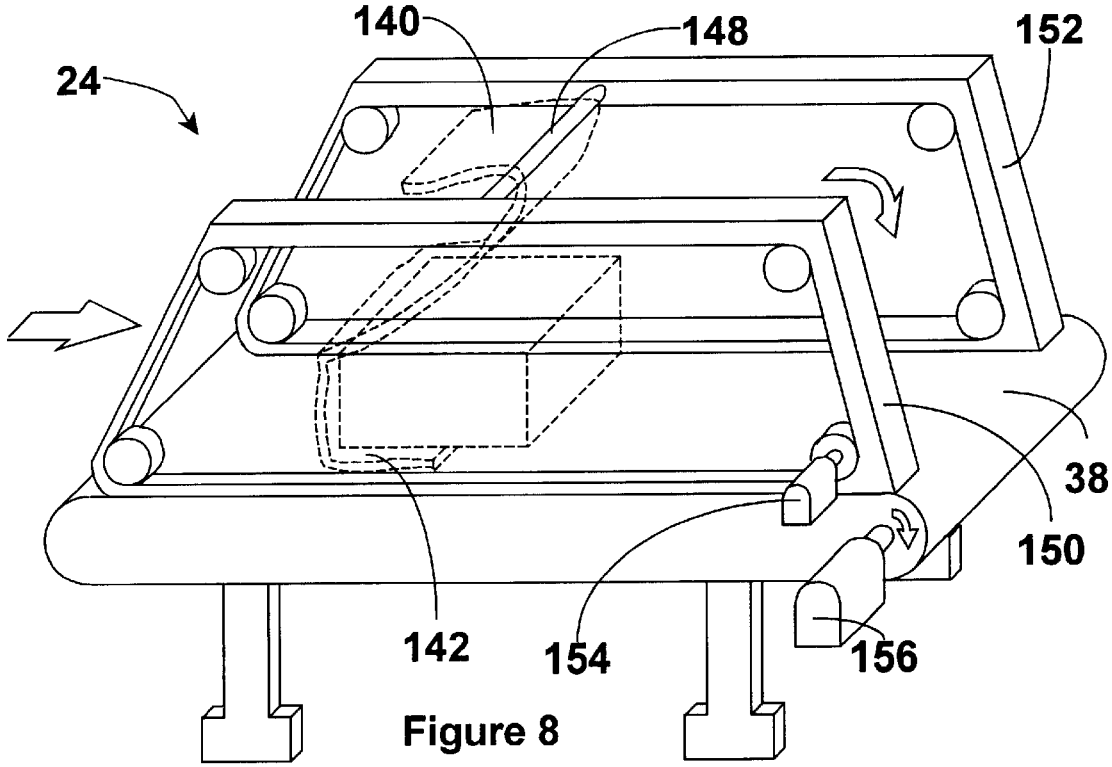
FIG. 8 is a perspective view of a film wrapping module indicating the use of two (2) onboard servo drives, one defining the speed of the conveyor and a second defining the speed with which the wrapper arm wraps the film.

A stacker module 20 may also be provided to perform the function of stacking every other package 112 on top of the preceding package 114 prior to exiting the module 20. The stacker conveyor 36 moves packages 114 in the direction shown. Lifter arms 108, 110 engage and lift and place every other package 112 on top of the preceding package 114 as shown in phantom in FIG. 6. The lifter arms 108, 110 ride on endless belts 116, 118 which are driven in the indicated direction. A servo drive 120 drives the endless belts 116, 118 and thereby controls the speed of lifter arms 108, 110 and the speed with which packages 112 are picked up and placed on the preceding package 114. The speed of the servo drive 120 will necessarily be faster and variable compared to the speed of the stacker conveyor 36. A servo drive 122 drives the stacker conveyor 36 such that packages are processed through the stacker module 20 at the same speed as through the other modules.

Figure 9:
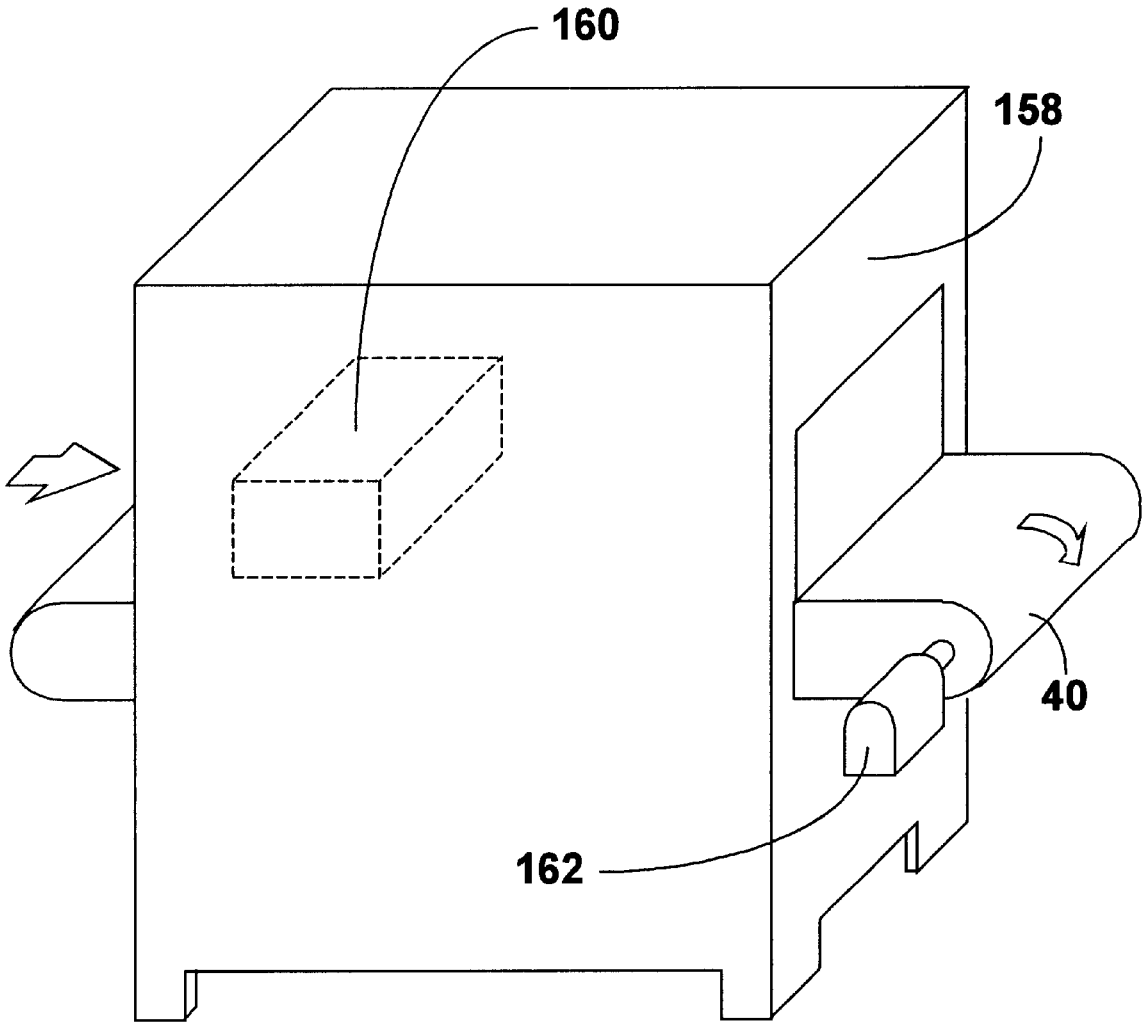
FIG. 9 is a perspective view of a heat shrink tunnel module wherein a conveyor moves package groups wrapped in film through a heat shrink tunnel. An onboard servo defines the speed of the conveyor and the speed with which packages are processed through the heat shrink tunnel.

Providing heat shrinkable film around packages as in a tray shrink packer, pad shrink packer or shrink packer requires an additional three modules to be employed. First, a film cutting module 22 is necessary wherein a spool of film 124 is provided, unrolled and threaded through the rest of the film cutting module 22. The film engages a guide roll 126 and is threaded between pinch rolls 128,129, 130, 131. A knife 134 is provided to cut the film off at a desired length to wrap a package. A standalone base 136 supports the spool 124, guide roll 126, pinch rolls 128, 129, 130, 131 and the rest of the film cutting module. A servo drive 138 coupled to pinch roll 129 controls the unrolling of the film and the supply thereof to the knife 134. A film wrapper module 24 is also necessary to receive a sheet 140 from the film cutting module 22. As a package 146 is received on film wrapper conveyor 38 and transported thereby, the front edge 142 of the sheet 140 is tucked under the package 146 in the film wrapper module 24. A film wrapper arm 148 engages the sheet 140 of film and wraps it around the package 146. The film wrapper arm 148 is driven around frame 150,152 and is necessarily driven at a higher rate of speed than the film wrapper conveyor 38 to allow completion of the film wrapping while the package 146 is still on the film wrapper conveyor 38. A servo drive 154 on the film wrapper arm 148 drives the film wrapper arm 148 accordingly. Meanwhile, servo drive 156 on the film wrapper conveyor 38 drives the film wrapper conveyor 38 at a pace consistent with the rest of the packaging machine 10. Finally, a heat shrink tunnel module 26 is provided down stream of the film wrapper module 24 to shrink the film 140 into tight engagement with the package 160. A housing 158 is provided which encloses heat and through which the package 160 passes in the direction indicated in FIG. 9. The heat shrink tunnel conveyor 40 is driven by a variable speed drive 162 at a rate consistent with the rest of the machine.

Figure 10:
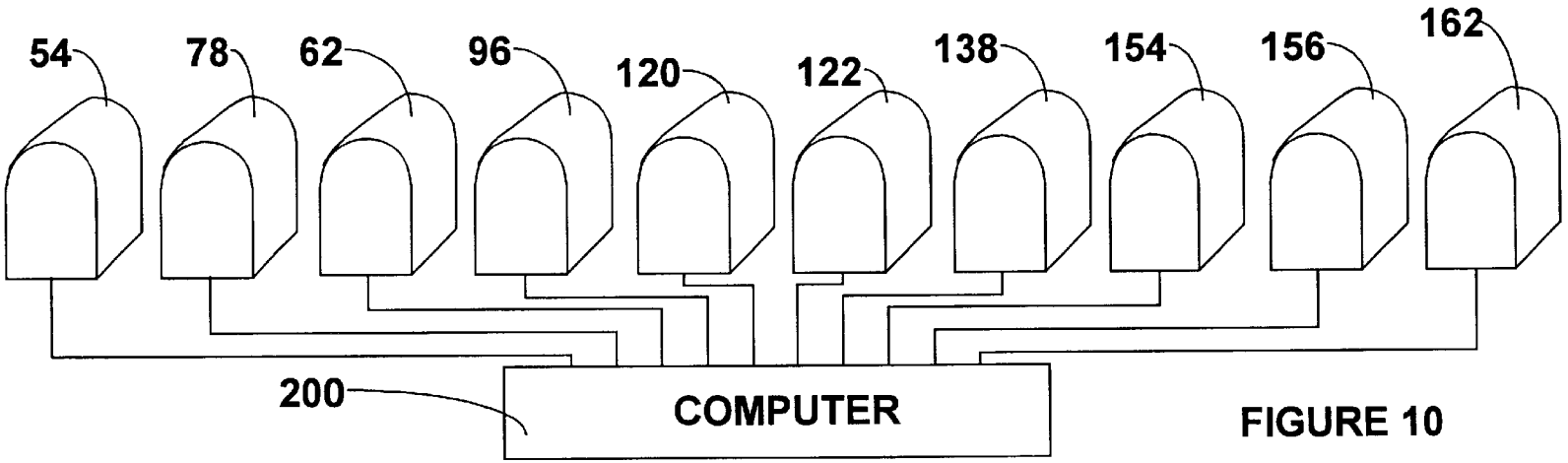
FIG. 10 is a schematic representation of the connection of the numerous servo drives onboard the various modules controlled by a supervisory computer to coordinate speed and operation of all the modules.

The embodiment of the packaging machine 10 of the present invention described above eliminates the need for a large frame for the equipment to be mounted on and provides modules that need not be mechanically linked. The speeds with which the modules 12, 14, 16,18, 20, 22, 24, 26 operate are controlled and coordinated by a supervisory computer 200 (see FIG. 10). Each module 12,14, 16,18, 20, 22, 24, 26 in the embodiment performs a discrete packaging function and includes conveyors driven by an onboard servo drive 54, 78, 62, 96,120, 122, 138, 154, 156, 162 which moves packages through it at a predetermined rate. By tightly controlling the onboard drives through the use of precise electrical drives and feedback, it is possible to arrange the modules 12, 14,16, 18, 20, 22, 24, 26 end to end and have them orderly and continuously create packages without the need for mechanically linking them together. The infeed lane divider drive 54, the collation and synchronization drive 62, the gluing and closing drive 96, the stacker drive 122, the film wrap drive 156 and the heat shrink tunnel drive 162 all have their speeds calculated, checked and modified by the supervisory computer 200 to ensure orderly and continuous operation of the packaging machine. The computer 200 can speed up or slow down all of the modules or selected modules only in the event a module is running too fast or too slow. By tightly controlling the speed within each module 12, 14, 16, 18, 20, 22, 24, 26 efficiencies are realized because the servo drives 54, 78, 62, 96, 120, 122, 138, 154, 156, 162 can, within a module, slow down the speed to perform difficult operations then increase the speed to perform routine functions. The computer 200 controls the speed of the modules 12, 14, 16, 18, 20, 22, 24, 26 differently, but in such a way that the flow of articles from modules to module is coordinated. The control of the servo drives 54, 78, 62, 96, 120, 122, 138, 154, 156, 162 by the computer 200 provides great flexibility and variability of the packaging machine 10.

Defining the packaging machine 10 through the use of multiple modules 12, 14, 16, 18, 20, 22, 24, 26 that are interchangeable and are readily added or removed to change functionality of the machine 10 has significant advantages. The use of a supervisory computer 200 to control the drives 54, 78, 62, 96, 120, 122, 138, 154, 156, 162 and the operation of the machine is easy and removes the necessity of mechanically linking the modules together 12,14, 16, 18, 20, 22, 24, 26. The interchangability and removability of the modules 12,14,16,18, 20, 22, 24, 26 of the present invention are advantageous in that a problem with one module does not incapacitate the entire machine 10. A single problematic module can be taken off line and replaced, or taken off line and fixed while packaging continues. The various modules 12,14,16,18, 20, 22, 24, 26 disclosed herein perform separate, discrete functions of the packaging machine 10. The use of onboard drives 54, 78, 62, 96,120, 122, 138, 154,156, 162 and the lack of necessity of mechanical connection between modules 12, 14, 16,18, 20, 22, 24, 26 allows each module to perform as a separate machine. In addition, the commonality of parts between modules allows more efficient maintenance and less down time when a problem is encountered.

While the servo drives used with the various modules of the above described preferred embodiment have been depicted as being side mounted and directly coupled to the conveyors, other mechanical connections between the servo drives and conveyors, including, without limitation, alternate positioning with belt drives or through gearing, are specifically contemplated and do not depart from the principles of the present invention.

Figure 12:
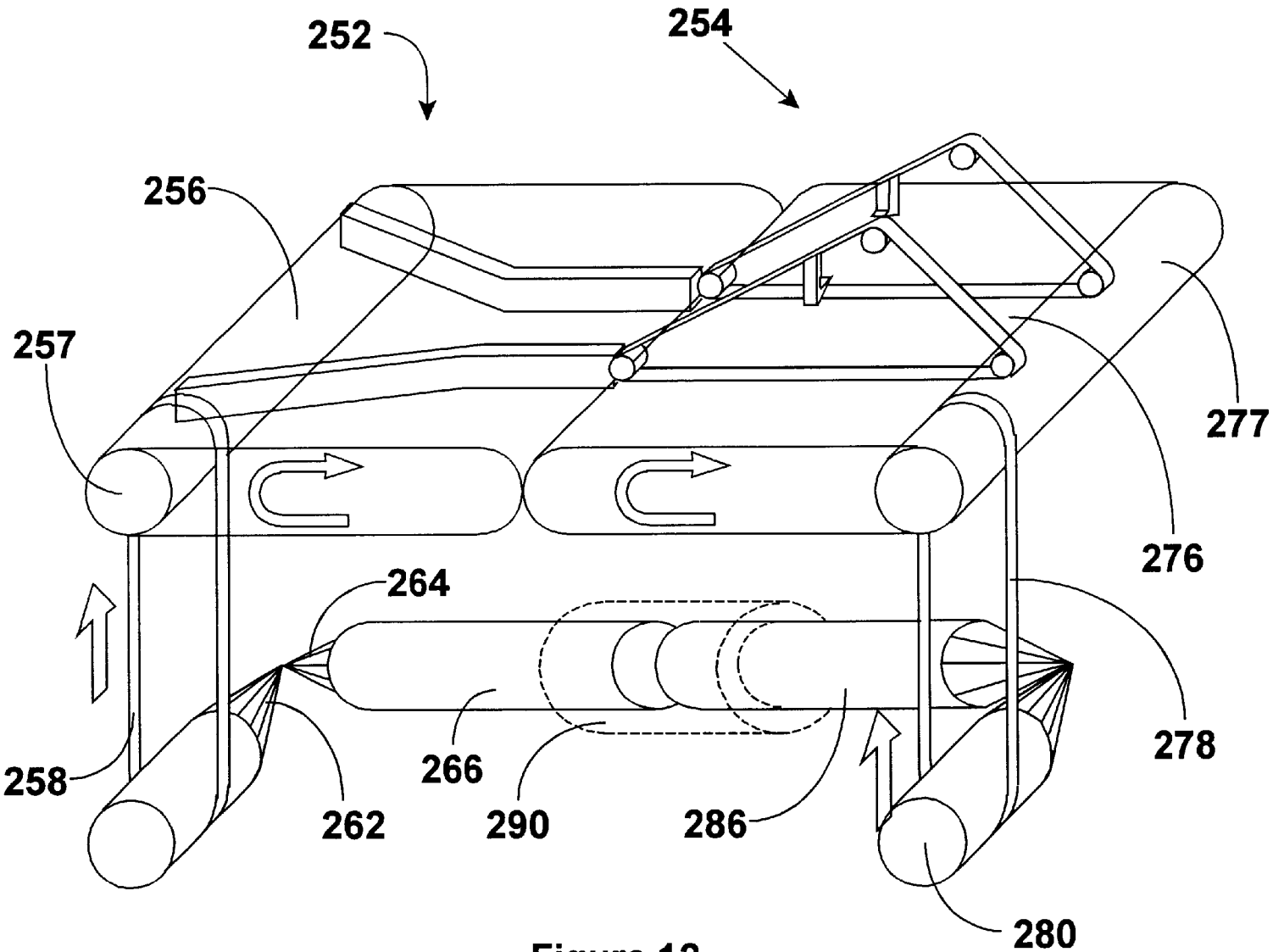
FIG. 12 is a perspective view of the modular packaging machine of the present invention illustrating the use of a drive shaft mounted on two successive modules and a mechanical coupling therebetween.

Another embodiment of the present invention is illustrated in FIG. 12 wherein an alternative module drive means 250 to the individual servo drives described above is illustrated. Specifically, FIG. 12 shows a gluing and closing module 252 and a stacker module 254 which perform successive steps in the packaging sequence. The conveyor 256 is shown in FIG. 12 being driven by a belt 258 which engages its drive sprocket 257. The belt 258 is threaded around a hub 260, the teeth 262 of which engage teeth 264 of a drive shaft 266 which is mounted below the conveyor 256. Rotation of the drive shaft 266 results in rotation of the hub 260, belt 258 and conveyor drive sprocket 257.

As shown in FIG. 12, the stacker module 254 has a similar mechanical linkage wherein the conveyor 276 and its sprocket 277 are driven by belt 278, hub 280 and drive shaft 286.

The closing and gluing module 252 and the stacker module 254 shown in FIG. 12 are designed such that, when positioned in succession as shown, the closing and gluing module drive shaft 266 is on the same center line with the stacker module drive shaft 286. A mechanical coupling 290 affixed to bridge the gap between the drive shafts 266, 286 thus completes the mechanical linkage so that rotation of one drive shaft causes the other to rotate. In this way a single drive motor may be positioned anywhere along the combined drive shaft to drive both modules. Other modules similarly designed with a drive shaft on the same center line will be similarly compatible. Thus, the modularity of the packaging machine is maintained without requiring an individual servo drive on each module.

Rather, successive modules, such as the closing and gluing module 252 and stacker module 254 depicted in FIG. 12, are readily interchangeable and removable by installing or removing simple mechanical linkages such as the coupling 290. The modules 252, 254 are designed such that their drive shafts are aligned or readily accessible to allow the easy and quick installation or removal of the modules.

The foregoing description of a preferred embodiment of the invention has been presented for purpose of illustration and description. It is not intended to be exhaustive or to limit the invention to the precise form disclosed. Obvious modification or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

We claim:

1. A machine for packaging articles comprising:

multiple mechanically independent modules, each of said modules performing a discrete function in the packaging of said articles arranged such that said machine is alternately defined as a tray shrink packer, pad shrink packer, shrink packer, stacker and turner by inserting and removing selected of said multiple mechanically independent modules;

means for conveying said articles through said machine comprising an individual conveyor means on each of said multiple mechanically independent modules, each of said individual conveyor means being mechanically independent from all other said individual conveyor means; and means for coordinating said means for conveying to provide a flow of articles from each of said multiple modules to the next without mechanically linking said means for conveying.

2. The machine as set forth in claim 1 wherein said individual conveyor means on each of said multiple modules further comprise a conveyor on each of said multiple modules arranged at identical heights.

3. The machine as set forth in claim 2 wherein each of said multiple modules is interchangeable and is readily added and removed to change functionality of said machine.

4. The machine as set forth in claim 3 wherein said coordinating means comprises a computer that controls said means for conveying.

5. The machine as set forth in claim 4 wherein said individual conveying means comprises a conveyor belt on each of said modules driven by a servo drive mounted on each of said modules, each said servo drive being connected to and tightly controlled by said computer through the use of precise electrical drives and feedback such that each said module can be slowed down and sped up to coordinate flow of articles through all said modules.

6. The machine as set forth in claim 5 wherein said multiple modules comprise at least an infeed conveyor lane divider module.

7. The machine as set forth in claim 6 wherein said multiple modules further comprise a collation and synchronization module.

8. The machine as set forth in claim 7 wherein said multiple modules further comprise a blank magazine and infeed tray module, a gluing and closing module, a stacker module, a film cutting module, a film wrapper module, and a heat shrink tunnel module.

* * * * *